United States Patent [19]

Brack et al.

[11] 4,397,203

[45] Aug. 9, 1983

[54] TOWEL CUTTING MACHINE

[76] Inventors: Frank T. Brack, 87 Laredo La., Boca Raton, Fla. 33431; Frank B. Brack, 4280 NW. 9th Ct., Pompano Beach, Fla. 33063

[21] Appl. No.: 204,455

[22] Filed: Nov. 6, 1980

[51] Int. Cl.[3] ..... B26D 5/38; B26D 7/14

[52] U.S. Cl. ..... 83/156; 83/175; 83/212; 83/262; 83/269; 83/371

[58] Field of Search ..... 83/175, 212, 262, 269, 83/371, 156

[56] References Cited

U.S. PATENT DOCUMENTS

| | | | |
|---|---|---|---|
| 857,540 | 6/1907 | Robinson | 83/269 |
| 2,170,609 | 8/1939 | Nedal | 83/371 |
| 2,966,086 | 12/1960 | Sjostrom | 83/175 |
| 3,182,536 | 5/1965 | Sumpter et al. | 83/175 |
| 3,776,078 | 12/1973 | Perlman | 83/371 |

*Primary Examiner*—James G. Smith
*Assistant Examiner*—K. Bradford Adolphson
*Attorney, Agent, or Firm*—Malin & Haley

[57] ABSTRACT

A towel cutting machine includes a drive feed device including rollers for feeding strip material from a towel supply roll to and between a cutter blade and braking-sensing mechanism and into a set of driver pull slip-clutch rollers to pull the strip of material through the towel cutting machine, to hold the strip material taut during cutting and to draw off the towel severed from the end of the strip material after being cut.

4 Claims, 8 Drawing Figures

Fig. 5.
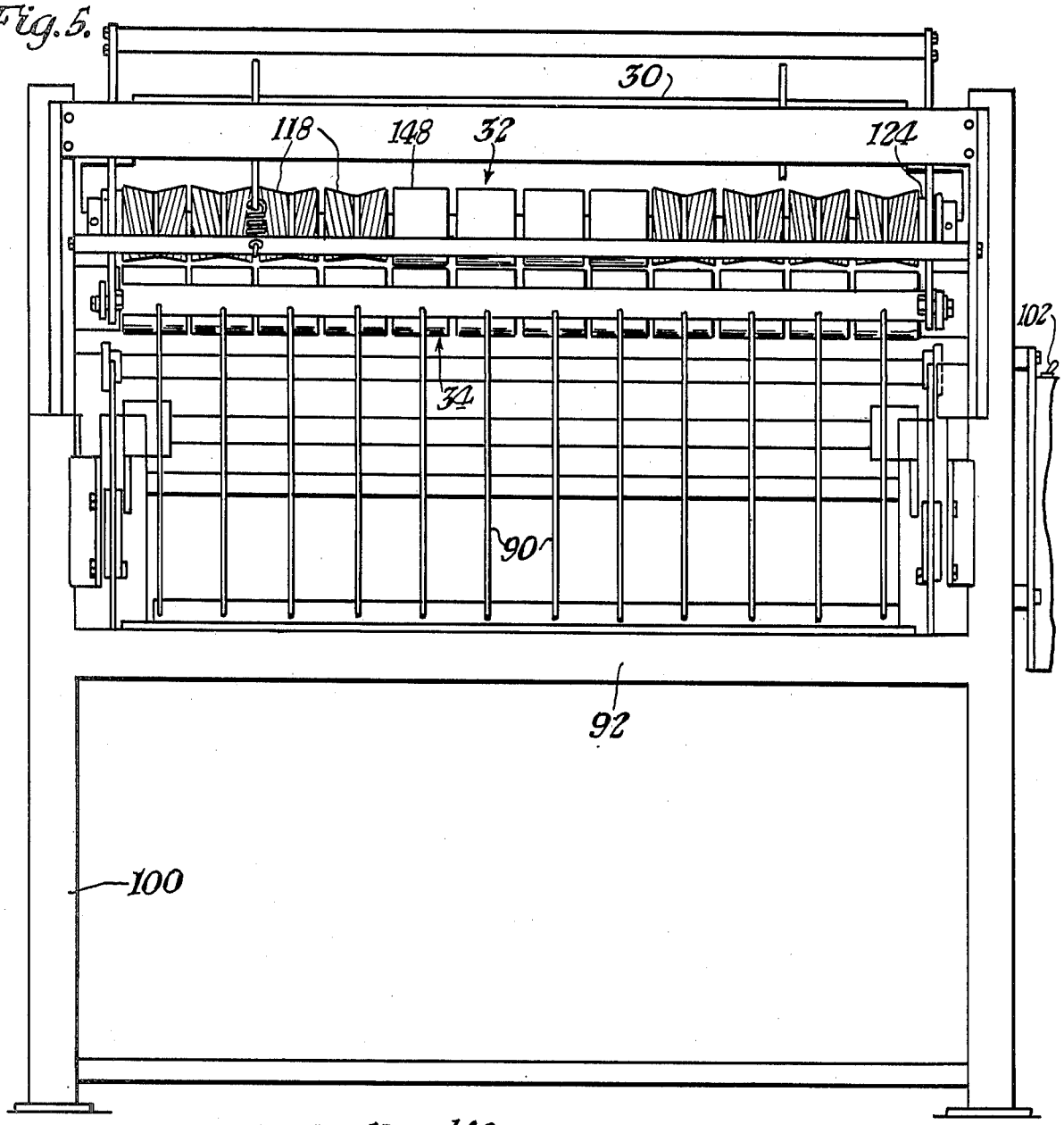
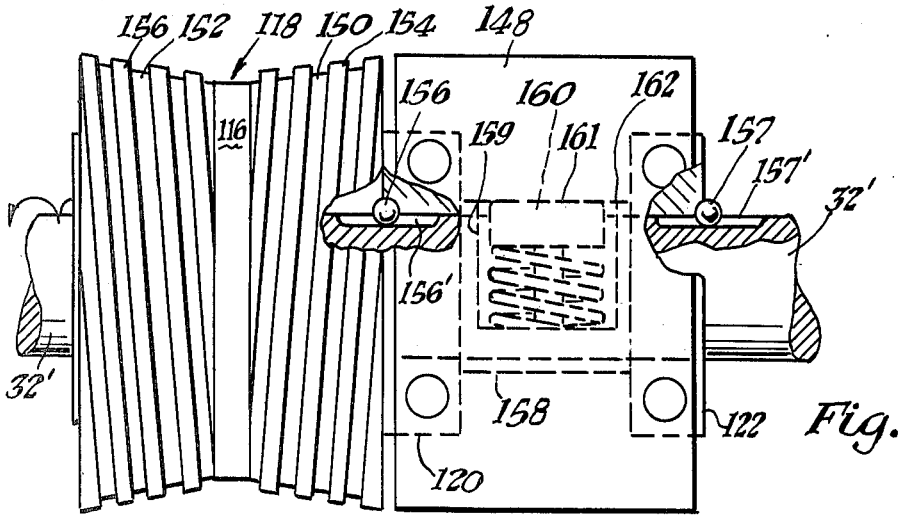
Fig. 6.

TOWEL CUTTING MACHINE

BACKGROUND OF THE INVENTION

A long strip of material such as terrycloth is shipped in large rolls from textile mills to distribution areas. The rolls of material must be cut into smaller, individual lengths to provide individual towels to be sold to retail consumers. The towels are cut along fringe areas in the strip of material. Handcutting of the strip of material is too time consuming. Machine cutting methods and apparatus such as disclosed in prior U.S. Pat. Nos. 3,182,536 and 2,966,086 are either too complex or too expensive for local cutting operators.

The present invention combines non complex feeding, pulling, braking-sensing, and cutting apparatus into a relatively small, inexpensive towel cutting machine. The present invention provides an efficient machine for cutting strip material into short, individual towels.

SUMMARY OF THE INVENTION

The new and improved towel cutting machine includes a drive feed device including rollers for feeding strip material from a towel supply roll to and between a cutter blade and braking-sensing mechanism and into a set of driver pull slip-clutch rollers to pull the strip of material through the towel cutting machine, to hold the strip material taut during cutting and to draw off the towel severed from the end of the strip material after being cut.

The drive feed device consists of a idler roller and a driven cylindrical drive feed roller movable from a disengaged position to a rotating driving engaged position and back to a disengaged non driving position. The drive feed roller, which when engaged, applies traction to the end portion of the strip material or strip of towel material from the towel roll. The drive feed roller is pressed against the strip material and the idler roller that is positioned on the other side of the strip material. The strip material from the towel roll is fed downstream in strip form through the towel cutting machine to the pull slip-clutch rollers by the drive feed device. The strip material is fed from the drive feed device through the cutter blade and braking-sensing mechanism and up to the pull slip-clutch rollers that thereafter pulls the strip material through the towel cutting machine.

The cutter blade and braking-sensing mechanism includes a cutting means and braking-sensing apparatus. The braking-sensing apparatus includes sensing means and strip material braking means. The braking means locate the next fringe areas in the strip material and stop the fringe area and then brakes the downstream movement of the strip material to a stop. The sensing means senses the braking and signals the cutting means. The cutting means is for cutting the mid line of the fixed fringe area. The cutting means includes a fixed blade over which the strip material passes or rides and a movable blade above the strip material which is activated by the positive movement of the braking sensing apparatus. The braking means includes a mechanical braking bar located or stationed adjacent and upstream of the cutting means. The braking means also includes a trap door that is positioned below the braking bar and the strip material. The braking bar is positioned above or below the strip material, preferrably above the strip material. The braking bar has several fingers or protruberances which ride on and are pressed against the strip material moving past the braking bar beneath the fingers.

The strip material on the towel roll is woven with intermittently-spaced fringe areas or sections that designate each towel and designate where the strip material is to be cut. The fringe area includes only longitudinal threads that hold the strip material together. The fringe area does not include transverse threads. As the fringe area passes under the braking bar with the trap door open, the fingers slip through and between the longitudinal threads in the fringe area or the fringe area moves up on the fingers of the sensing bar to locate the fringe area. The upstream sides of the fingers act as the strip material braking means. The fingers after passing through the fringe area provide braking by catching the strip material and then moving a short distance downstream to provide a positive sensing signal for cutting the strip material. The fingers hold the strip material in a fixed position in the towel cutting the machine. The strip material is held taut by the continued action of the downstream pull slip-clutch rollers.

The drive feed rollers are engaged for only a short time and are moved to a disengaged position above the strip material. The flow or movement of strip material through the towel cutting machine is then solely governed by the rotational movement of the pull slip-clutch rollers.

After engagement of the braking bar fingers with the upstream transverse edge of the fringe area of the strip material, the strip material is stopped and stretched over the cutting blades between the sensing bar station and the pull slip-clutch rollers. The pull slip-clutch rollers are allowed to slip on the drive shaft of the pull slip-clutch rollers. Therefore the pull slip-clutch rollers provide a constant tension force on the leading portion of the strip material.

The downward travel of the braking bar actuates a switch to actuate the piston for moving the movable cutter blade to cut action the strip material transversely through the middle of the sensed fringed area. After severance is completed, the pull slip-clutch rollers automatically begin to move severed towel. The pull slip-clutch rollers move the towel out of the towel cutting machine.

The movable cutting blade is then moved up to a disengaged position. The sensing bar fingers are also moved up to a disengaged position. The drive feed device is again moved into engagement and rotated to move the strip material through the towel cutting machine to repeat the cycle of operation.

The pull slip-clutch rollers are movably connected on the pull slip-clutch roller drive shaft. The pull slip-clutch roller drive shaft rotates the pull slip-clutch rollers through a spring loaded clutch. A plurality of spring loaded clutchs are connected between each of the pull slip-clutch roller drive shaft and the pull slip-clutch roller. The spring and the mica clutching member is connected to the drive shaft. The spring presses the mica member against the inner surface of the pull slip-clutch roller. The clutch allows the roller to slip on the drive shaft when the strip material is caught and temporarily fixed in the cutting position by the upstream fingers of the braking bar engaged in the fringe area of the strip material. This slipping action creates a constant frictional force on the pull slip-clutch roller that is sufficient to tension in the strip material during the cutting operation.

It is an object of this invention to provide a non complex apparatus for rapidly cutting lengths of fringed strip material from a towel roll shorter.

It is another object of this invention to provide a towel cutting machine including a drive or feeding means, a fringe braking-sensing means, a cutting means and a pull slip-clutch means for cutting individual fringed towels from a towel roll.

It is another object of this invention to provide a compact towel cutting machine for a roll of fringed towels.

In accordance with these and other objects which will be apparent hereinafter, the instant invention will now be described with particular reference to the accompanying drawings.

BRIEF DESCRIPTION OF THE DRAWINGS

In the drawings:

FIG. 5 is a front elevation view of the cutting machine from the exit end of the machine.

FIG. 6 is a partial front view of the pull slip-clutch roller and shaft.

DESCRIPTION OF THE PREFERRED EMBODIMENT

Figure 1:
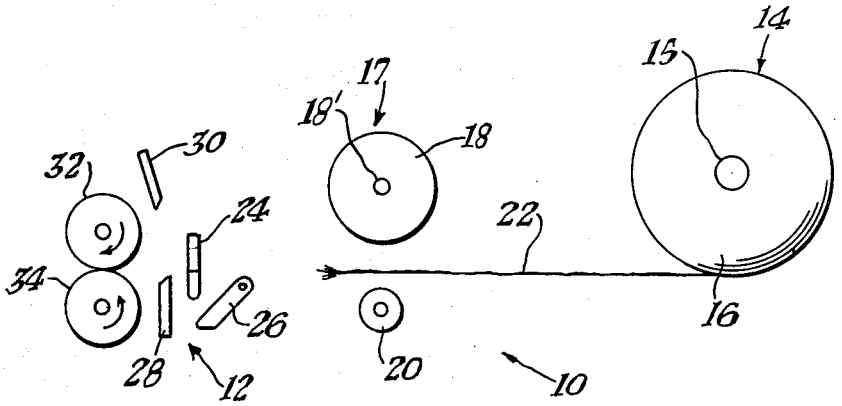
FIG. 1 is a side illustration of the towel cutting machine at the beginning of a cycle of operation with the strip of material positioned between the disengaged drive feed device.
Figure 7:
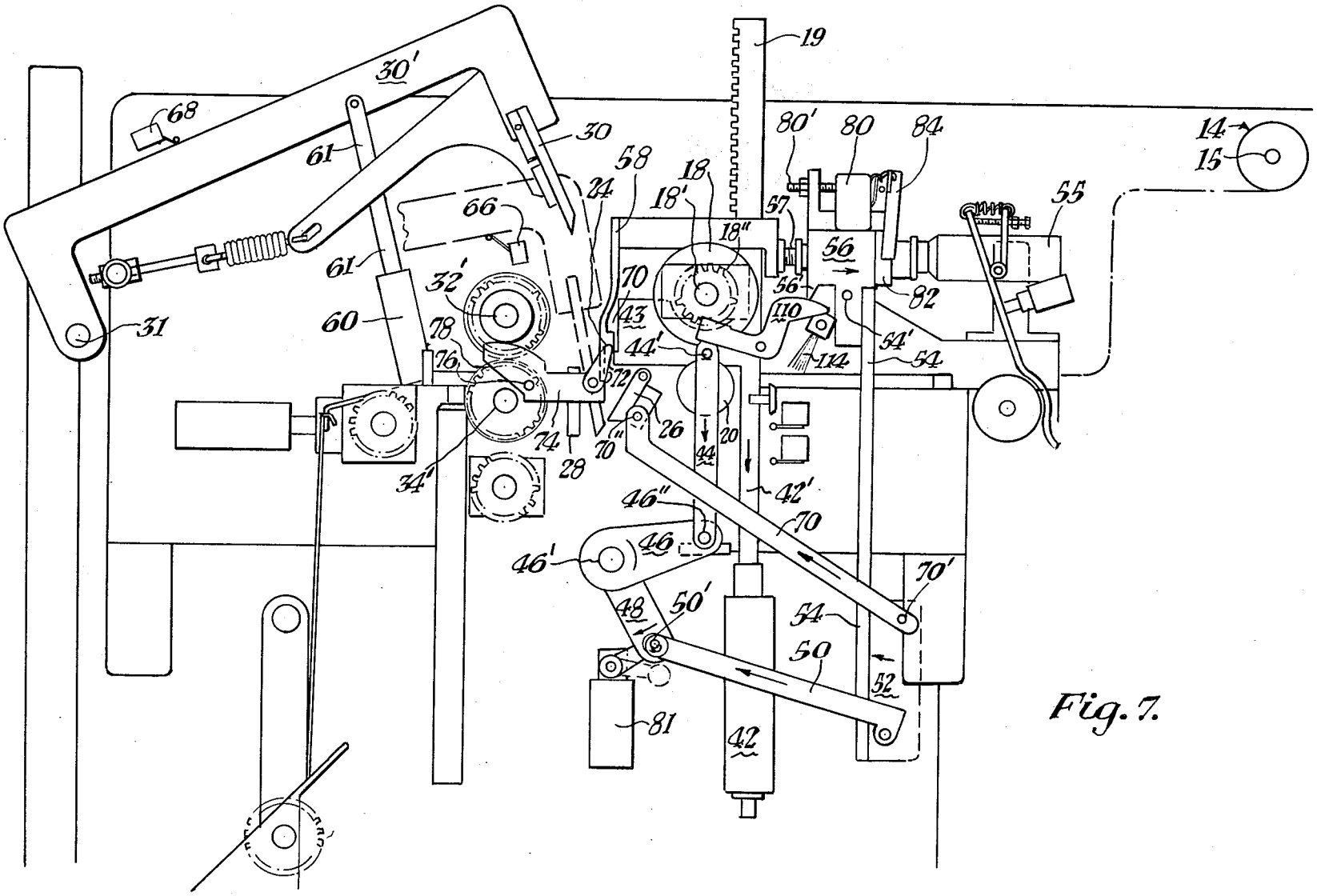
FIG. 7 is a side view of the interconnecting mechanical linkage.

Referring now to FIGS. 1 through 4 illustrating a side views of the cycle of operation of the towel cutting machine 10. The start of the cycle is shown in FIG. 1 and FIG. 7 at the start of the cycle with a towel supply roll 14 has a roll of towels 16 on a shaft 15. The supply roll 14 has a strip of material whose distal end is hand fed to the open drive feed device 17. The drive feed device 17, includes a movable drive feed roll 18 with shaft 18' shown in a disengaged up position in FIGS. 1 and 7 by piston 42, line 42' and lift block 43, and an idle roller 20 in a fixed lower position.

Figure 2:
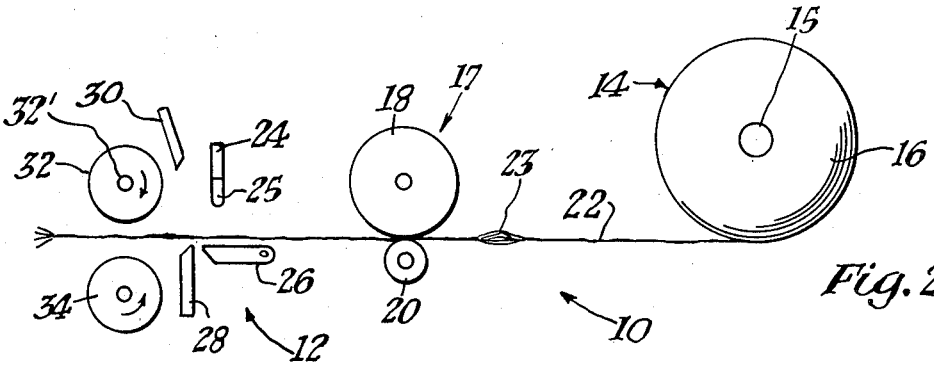
FIG. 2 is a side illustration of the towel cutting machine with the drive feed device engaged for moving the strip of towel material through the machine to the pull slip-clutch rollers.

As shown in FIGS. 1 and 2 the strip material is now fed from the towel supply roll 14 by drive feed device 17 completely through the towel cutting machine 10. The drive feed roll 18 is rotated by rack 19 by engagement with teeth 18'' when lift block 43 is moved down as shown in FIG. 7 in order to move the strip material into the pull slip-clutch rollers 32 and 34 as shown in FIG. 2.

The cutting blade and sensing mechanism area 12 lying between the two sets of rollers includes movable cutter blade 30 and fixed cutter blade 28 and the finger bar 24 trap door 26. Movable cutter blade 30 is shown in FIGS. 1 and 7 in an open position and is moved by piston 60 through link 61 and member 30 pivoting on pin 31. The cutting blade and sensing mechanism area 12 shows the finger bar 24 in a lower engaging position with trap door 26 in an open position in FIGS. 1 and 7. The finger bar 24 and trap door 26 are momentarily moved into an open position as shown in FIG. 2.

Referring now to FIG. 2, with the drive feed device 17 engaged momentarily and rotated by rack 19 shown in FIG. 7 by the downward movement of piston shaft 42 through piston 42. The finger bar 24 is momentarily returned to the up position by linkage 42' with portion 43 moving down, 44 connected by pin 44', 46 on pivot shaft 46' connected by pin 46'', 48 fixed to 46, 50 connected by pin 50', 52, 54 on pivot shaft 54' with portion 56 and 58 to fingers 24. The trap door 26 is moved by link 52 through pin 70', link 70 and pin 70''. The drive feed roller 18 is moved down into engagement with the top of the strip material 22. The drive feed roller 18 presses the strip material between it and the idler roller 20. The strip material 16 on the supply roll 14 is fed downstream between the cutting blade and braking-sensing mechanism area or apparatus 12 including the open movable cutter blade 30 in an up position and fixed blade 28 and between the raised finger bar 24 and raised trap door 26 to facilitate feeding the end portion of the sheet material 22 to the pull slip-clutch rolls 32 and 34 on shaft 32' and 34' respectively. The end portion of strip material 22 moves over the closed trap door 26 and the lower fixed cutting blade 28 as illustrated in FIG. 2. The finger bar 24 and trap door 26 remain raised only momentarily in order to aid initially feeding the strip material through the towel cutting machine.

The pull slip-clutch rolls are momentarily opened as shown in FIG. 2 to aid feeding the strip material 22. When the lift bar 43 and member 42' are moved down by piston 42, the lip 70 engage link 72 to move clockwise the lift link 74 about pivot pin 76 to lift shaft 32' on the cam face 78. The shaft 32 moves roll 32 up. FIG. 7 shows roller shaft 34' with a pill slip-clutch roller in a fixed position. Link 70 is biased by a spring into the position shown in FIG. 7. When lift bar 43 and lip 70 move to a lower position, link 72 moves pass lift bar 43 allowing shaft 32' to automatically move down to engage the pull slip-clutch roller to pull the strip of material 22 through the towel machine.

Figure 3:
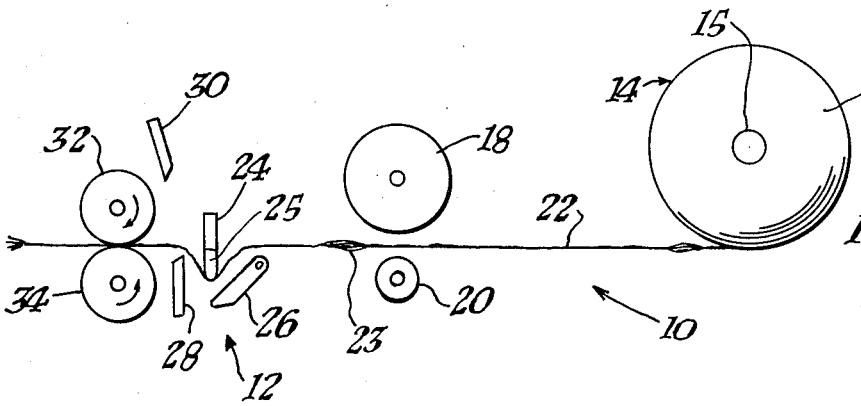
FIG. 3 is a side illustration of the towel cutting machine with the braking bar fingers engaging the strip of material and the pull slip-clutch rollers engaged to pull the strip of material through the towel cutting machine.
Figure 4:
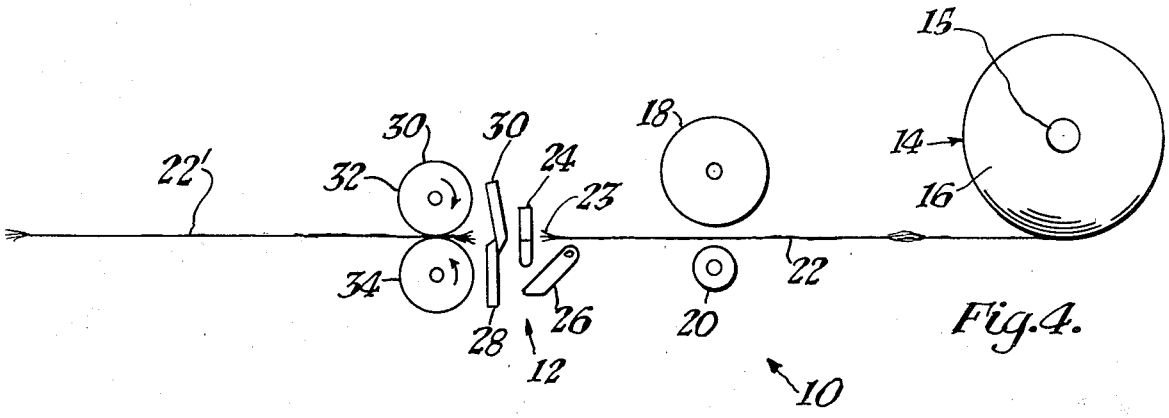
FIG. 4 is an illustration of the towel cutting machine as shown in FIG. 3 just after the cutting blades engaged in the strip material held by the braking bar fingers and the pull slip-clutch rollers moving the cut towel out of the machine.

Referring now to FIG. 3, the sheet material or strip 22 is caught between the upper pull slip-clutch roller 32 and lower pull slip-clutch roller 34. The slip-clutch rollers are automatically moved into engagement to pull the sheet material 22. The finger bar 24 and trap door 26 are thereafter lowered by piston 42 moving link 42' up, moving lift bar 43 up with link 44, moving link 46 and 48 counter clockwise about pin 46', and moving link 50, 52, 54, 56, 58 and finger bar 24 counterclockwise about pin 54' so that the fingers at are pressed against the sheet material or strip material 22 as illustrated in FIG. 3. The fingers pass through the fringe area 23 on the strip material 22. Once the fingers engage the fringe area 23 the drive feed roller 18 is disengaged. When the lower individual fingers on finger bar 24 pass through the fringe area the upstream edge of the fingers engage the lead transverse threads at the edge of the fringe area to stop the strip material 22. The finger and finger bar 24, member 58 and member 82 are to the left against a biasing spring in housing or member 56. Switch 80 is fixed on member 56 and an engaging link 84 is connected to member 82. Switch 80 may be adjusted by movement of adjusting screw 80'. Member 84 switches switch 80 which activates piston 60 to move link 61 and 30' about pin 31 to move knife 30 to cut the fringe area 23 as shown in FIG. 4.

The pull slip-clutch rolls 32 and 34 pull the cut towel material 22' through the towel machine 4 when the fringe area 23 is stopped by the individual fingers 25 on finger bar 24. The pull slip-clutch rollers 32 and 34 now begin to slip on their respective driven shafts. The traction of pull slip-clutch rollers 32 and 34 tensions the towel material or strip 22 from the finger bar 24 over the fixed cutter blade 28. Then the movable blade 30 shears the width of the strip material. The knife blade or cutting blade 30 moves into engagement with the sheet material 22 to sever it through scissor type action. The cutting edge of the blade 30 is preferably Λ-shaped to provide scissor type action. Once severed, the single towel section 22' is pulled out of the machine by the pull slip-clutch rollers 32 and 34. An air stream may be used to move leading edge of the strip on to members 90. Another stream of air flips the towel over bar 92.

The cycle is then completed when the movable cutting blade 30 moves upwared to a disengaged position. The cutting blade hits an electrical switch when it reaches the position shown in FIG. 4 or the phantom position shown in FIG. 7. The cycle is repeated over and over to cut all the towel material 16 on the roller 14 into individual towels.

Rocking arm 110 is actuated by moving member 56 by projection 56'. The rocker arm 110 aids the lifting of the drive roller shaft 18'

The position of the fingers 25 and finger bar 24 governs the cutting line in the fringe area. Screw 57 on each side of the machine may be adjusted by moving handle 55. The movement of screw 57 moves the fingers relativel to member 56.

The brush 114 holds the strip material in the machine before the drive rollers are engaged.

FIG. 5 shows the frame 100 with towel bar 92 and generally vertical member 90. The start switches and control box is shown at 102. The pull slip-clutch rollers 32 and 34 and illustrated with the centering rolls 118 and plain rollers 148. A portion of the cutting blade 30 is shown.

In FIG. 6 a portion of the pull slip-clutch roller 32 is shown. The pull shaft 32' is connected to each roller either the centering rolls 118 or plain rolls 148 by a slip-clutch. The slip-clutch 160 is a mica piece on the end of spring 158 placed opening 159 in shaft 32'. The upper surface 161 of the clutch member 160 bears against the inner surface 162 of the roller 148. Each roller has ball bearing assemblies 120 and 122. The rollers are separated from one another and from the lock member 124 on the end of the group of rollers as shown in FIG. 5, by a ball bearing such as 156 or 157, in grooves 156' and 157'.

The outer rollers are grooved with spiral grooves 150 and 152 leaving spiral engaging ridges 154 and 156 to move an edge of a towel strip of material toward the center 116 having a smaller diameter. This accommodates a thicker edge portion by moving it to the small diameter. This also holds the towel strip of material in a spread position for a better cut or straighter cut of the fringe area.

Figure 8:
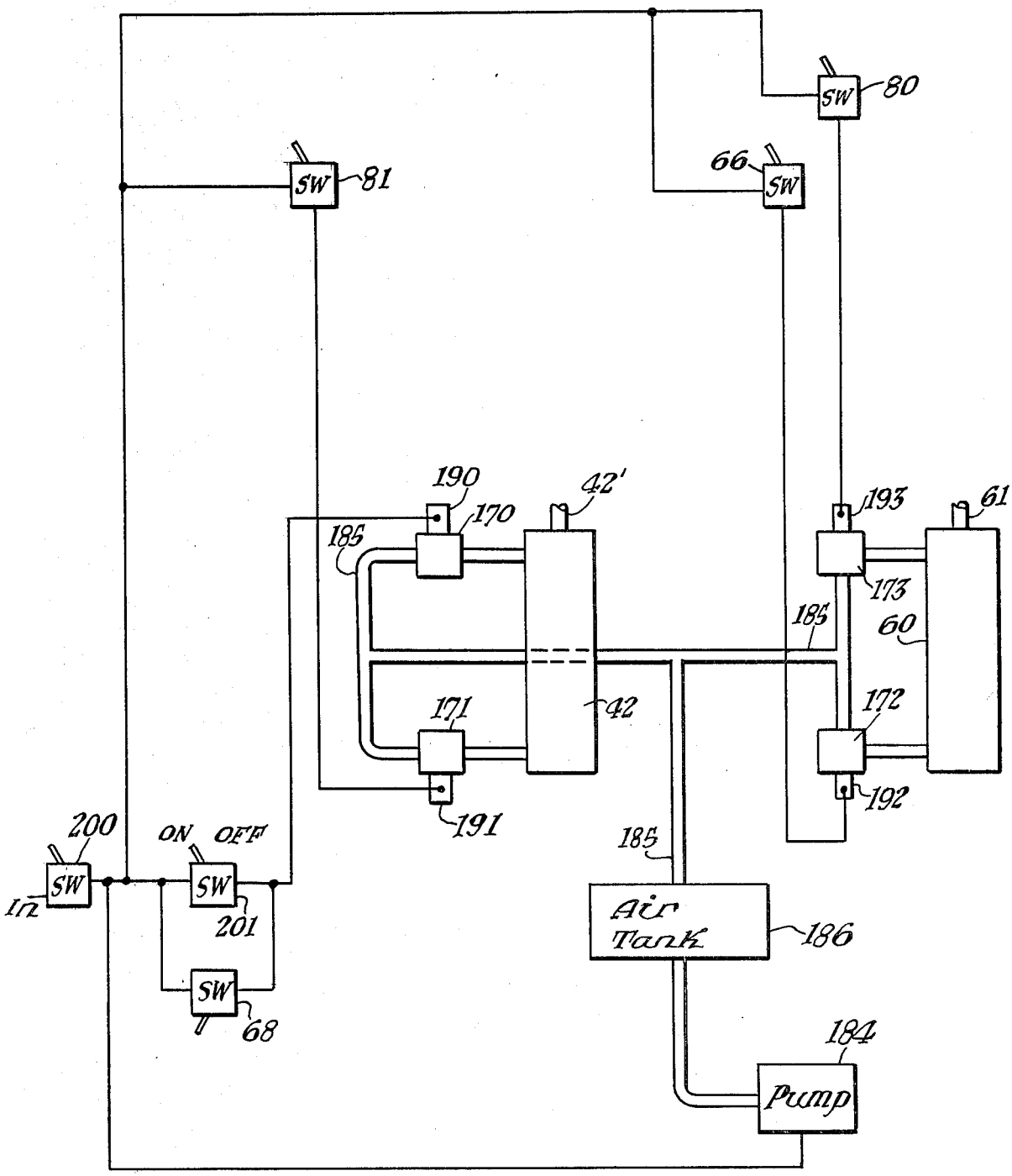
FIG. 8 is a schematic diagram of the electrical and fluid control means.

Referring now to FIG. 8, the control system includes an air pump 184, an air tank 188 connected to the air pump 186 and air line 185 connecting the air tank to the air valves 170, 171, 172 and 173 that are connected to operate the pistons. The air valves are operated by electrical solenoid valves. The electrical solenoid valves are actuated by electrical switch means. Air valve 170 is operated by solenoid 190 to drive piston 42 and withdraw shaft 42'. Air valve 171 is operated by solenoid 191 to drive piston 42 and extended shaft 42'. Air valve 172 is operated by solenoid 192 to drive piston 60 and extend shaft 61. Air valve 173 is operated by solenoid 193 to drive piston 60 and withdraw shaft 61. The on-off switch 200 activates the electrical system and the pump 184. Start switch 201 initiates the operation by actuating piston 42 to move the linkage to move the towel cutting machine components from the position shown in FIG. 1 to that shown in FIG. 2 but also allowing the pull clutch-rollers to be automatically reengaged.

Switch 81 is activated by movement of the linkage attached to piston 42 when piston shaft 42' is completely withdrawn. Switch 81 in turn activates air valve 171 to extend shaft 42' and place the towel cutting machine components into the position as illustrated in FIG. 3.

When switch 80 is activated by downstream movement of the finger bar 24 it in turn activates solenoid 193 that activates air valve 173 to withdraw shaft 61. Switch 80 places the towel cutting machine components into the position as illustrated in FIG. 4. When the shaft 61 reaches its most inward position it activates switch 66 that activates solenoid 192 that activates valve 172 to extend shaft 61. Switch 66 places the towel cutting machine components into the position as illustrated in FIG. 1. Switch 68 may be placed in the positon shown to act as an automatic means for repeating the cycle of operation. Additional control switches and time delay means may be used to provide additional control.

The instant invention has been shown to and described herein in what is considered to be the most practical and preferred embodiment. It is recognized, however, that departures may be made therefrom within the scope of the invention and that obvious modifications will occur to a person skilled in the art.

What I claim is:

1. A towel cutting machine for cutting the entire transverse fringe portion connecting generally rectangular towel sections in a continuous strip of towel material, the fringe portion being generally linear and perpendicular to the longitudinal axis of the strip of towel material, said towel section having two opposed, parallel thickened edges generally perpendicular to the linear fringed portion comprising:

a frame means for housing a control means, a drive feed means, a pull slip-clutch means, a braking-sensing means, and a cutting blade means;

said control means for automatically controlling and repeating the cycle of operation of feeding, sensing, braking, and cutting of said machine connected to said frame;

said drive feed means connected to said frame and said control means for drive feeding the strip of towel material longitudinally downstream along a pathway through said machine with the fringe portions generally perpendicular to the direction of feeding;

said pull slip-clutch drive means for centering and pulling the strip of towel material through said machine connected to said control means, said pull slip-clutch drive means for retaining each rectangular towel section of the strip of towel material in a centered and tensioned position thereby permitting cutting of the entire linear fringe portion generally perpendicular to the longitudinal axis of the strip of towel material;

said cutting blade means and braking-sensing means connected to said frame means and said control means between said drive feed means and said pull slip-clutch drive means, said cutting blade means located between said slip-clutch drive means and said braking-sensing means;

said braking-sensing means for locating the linear fringe portion between each towel section on the strip of towel material and for fixing the position of the fringe portion generally perpendicular to the longitudinal axis of the strip of towel material on said machine between said braking-fringe sensing means and said pull slip-clutch drive means adjacent to said cutting blade means;

said control means for first operating said drive feed means into a towel strip material engaging position and moving the strip material through said machine and into said pull slip-clutch means with said cutting blade means and said braking-sensing means in open nonengaging position and for thereafter engaging said pull slip-clutch means;

said control means for then operating said drive feed means and said braking-sensing means into an engaging position and feeding the towel strip material until the braking-sensing means senses the fringe portion and engages the fringe portion;

said control means for thereafter activating said cutting blade means while said pull slip-clutch drive means in a slip condition maintaining non-slip tension on the towel strip material without rotating to cut the fringe portion of a towel section of the towel strip material; and said control means for automatically returning said cutting blade means to the nonengaging position and for activating said drive feed means if desired another cycle of operation.

2. A machine as set forth in claim 1 wherein said pull slip-clutch means for tensioning and pulling includes:

an outer roller means for contracting and centering the strip of towel material, and an inner shaft with a biased slip-clutch for driving said outer roller means.

3. A machine as set forth in claim 2 wherein said pull slip-clutch means includes;

a spring and at least one nylon frictional-bearing member movable in said shaft.

4. A machine as set forth in claim 3 wherein:

said outer roller means including a roller having a smaller diameter center portion with moving means for moving an edge of the strip material toward said center portion.

* * * * *